US005682081A

United States Patent [19]

Reynolds

[11] Patent Number: 5,682,081

[45] Date of Patent: Oct. 28, 1997

[54] PLASMA DISPLAY HAVING LINEAR BARRIERS

[76] Inventor: Jeffery Scott Reynolds, 6305 Hanover Ct., Fishers, Ind. 46038

[21] Appl. No.: 273,249

[22] Filed: Jul. 11, 1994

[51] Int. Cl.[6] ..... H01J 17/49

[52] U.S. Cl. ..... 313/584; 313/586; 313/582; 313/634

[58] Field of Search ..... 313/582, 584, 313/586, 587, 634; 220/2.1 R

[56] References Cited

U.S. PATENT DOCUMENTS

| | | | |
|---|---|---|---|
| 3,334,269 | 8/1967 | L'Heureux | 313/584 |
| 3,942,061 | 3/1976 | van Esdonk et al. | 313/584 |
| 4,002,945 | 1/1977 | Van Houten et al. | 313/584 |
| 4,516,053 | 5/1985 | Amano | 313/584 |
| 5,144,200 | 9/1992 | Kim | 313/584 |

OTHER PUBLICATIONS

Criscamagna et al, "Chapter 3, AC Plasma display", vol. 40, Topics in Applied Physics, 1980, ISBN No. 03870986832.

Eldridge, Jr.; "Applying Corrugated Dielectric to Gas Panel"; IBM Technical Disclosure Bulletin, vol. 19, No. 9, Feb. 1977.

*Primary Examiner*—Nimeshkumar Patel

*Attorney, Agent, or Firm*—Gordon R. Lindeen, III; Wanda K. Denson-Low

[57] ABSTRACT

A rear plate for a plasma display panel including: a substrate including a dielectric glass layer thereon, the dielectric glass layer having an upper surface; and a plurality of parallel, longitudinal, straight troughs defined in the upper surface.

3 Claims, 2 Drawing Sheets

PLASMA DISPLAY HAVING LINEAR BARRIERS

BACKGROUND OF THE INVENTION

1. Field of the Invention

The present invention relates to plasma display devices generally and, more particularly, but not by way of limitation, to a novel plasma display panel which is very economically manufactured.

2. Background Art

There is a great deal of interest in plasma display panels because such display devices consume far less space in the direction normal to the plane of the picture as compared to conventional cathode ray tubes. While the use of cathode ray tubes as display devices is quite widespread, they suffer from a number of other defects or undesirable features. Cathode ray tubes have a poor small area contrast ratio due to light scattering and a further phenomenon called "halo." When an electron beam impinges on a phosphor surface, that surface radiates light forwardly toward an observer, but light is also radiated inwardly, reflected and radiated back outwardly to form a bright donut or halo spaced around the central spot. This effectively enlarges the visible spot with consequent loss of perceived detail. Present day plasmas display technologies have somewhat similar problems which reduce resolution.

The basic theory of operation of alternating current plasma displays may be found in a number of sources such as U.S. Pat. Nos. 3,559,190; 3,935,494; and 4,233,623, as well as in "Chapter 3. AC Plasma Display," by T. N. Criscimagna and P. Pleshko, found in volume 40 of the series titled "Topics in Applied Physics," published by Springer Verlag in 1980, ISBN No. 03870986832.

Briefly, such display devices have a plurality of gas discharge cells arranged in a generally flat matrix, and first and second sets of spaced apart electrodes with each cell located intermediate one electrode of the first set and one electrode of the second set. The display panel is formed with a first generally flat dielectric plate having the first set of electrodes therein, a second generally flat dielectric having the second set of electrodes therein, and with the two plates sealed together about their common periphery to enclose a gas such as a neon-argon mixture. Phosphors responsive to ultraviolet radiation created by a discharge in a cell through the enclosed gas are coated on the one of the two plates through which the display is viewed or the selected gas may be one such as a neon-xenon mixture which has significant radiation in the visible spectrum in which case the phosphors may be eliminated.

In such known display devices, a gas discharge in one cell may energize the phosphors associated with one or more adjacent cells, resulting in a larger than desired basic picture element and a resultant loss of color purity. Attempts have been made to eliminate this "cross-talk" between adjacent cells by providing an intermediate layer in the form of a perforated plate having individual holes corresponding to individual cells. This attempt creates problems in evacuating the display device and refilling it with the desired gas and further eliminates the desired phenomenon of "priming" wherein some intercellular photon or charged particle migration reduces the voltage necessary to fire or energize a cell. Further attempts to isolate cells and eliminate cross-talk while retaining the priming feature and allowing charging of the display device with the proper gas mixture have included a zigzag pattern of passageways between cells (U.S. Pat. No. 3,869,630), an orthogonal array of grooves or troughs (U.S. Pat. No. 3,953,756), and dielectric glass spacing bosses separating the cells (U.S. Pat. No. 4,827,186. None of these is entirely satisfactory and all are relatively expensive to manufacture.

Accordingly, it is a principal object of the present invention to provide a plasma display panel which is economical to manufacture.

It is a further object of the invention to provide such a plasma display panel which greatly reduces cross-talk between colors.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, a rear plate for a plasma display panel, comprising: a substrate including a dielectric glass layer thereon, said dielectric glass layer having an upper surface; and a plurality of parallel, longitudinal, straight troughs defined in said upper surface.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
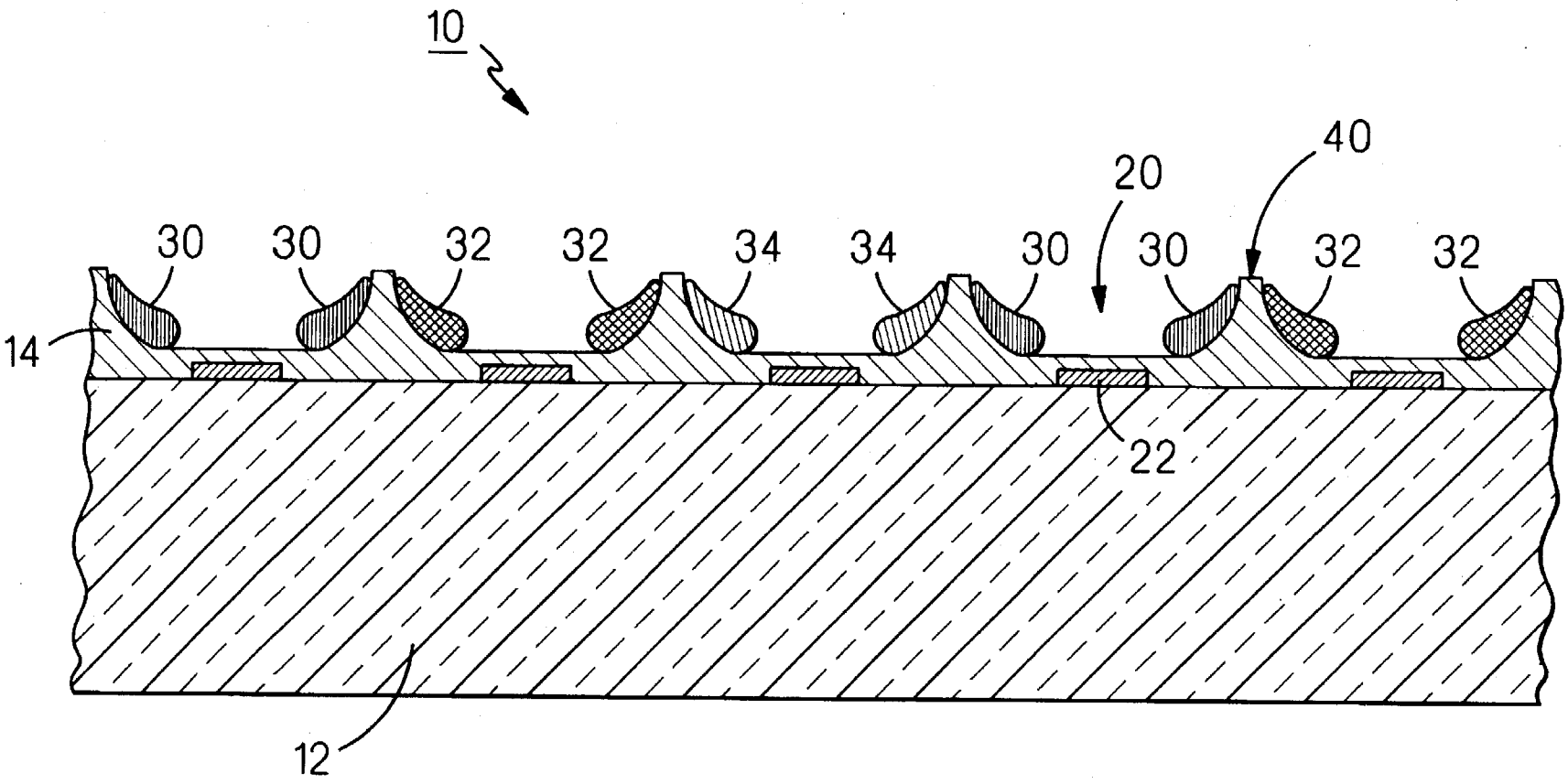
FIG. 1 is an enlarged, end elevational view, in cross-section, of a rear plate for a plasma display panel constructed according to the present invention.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

Figure 2:
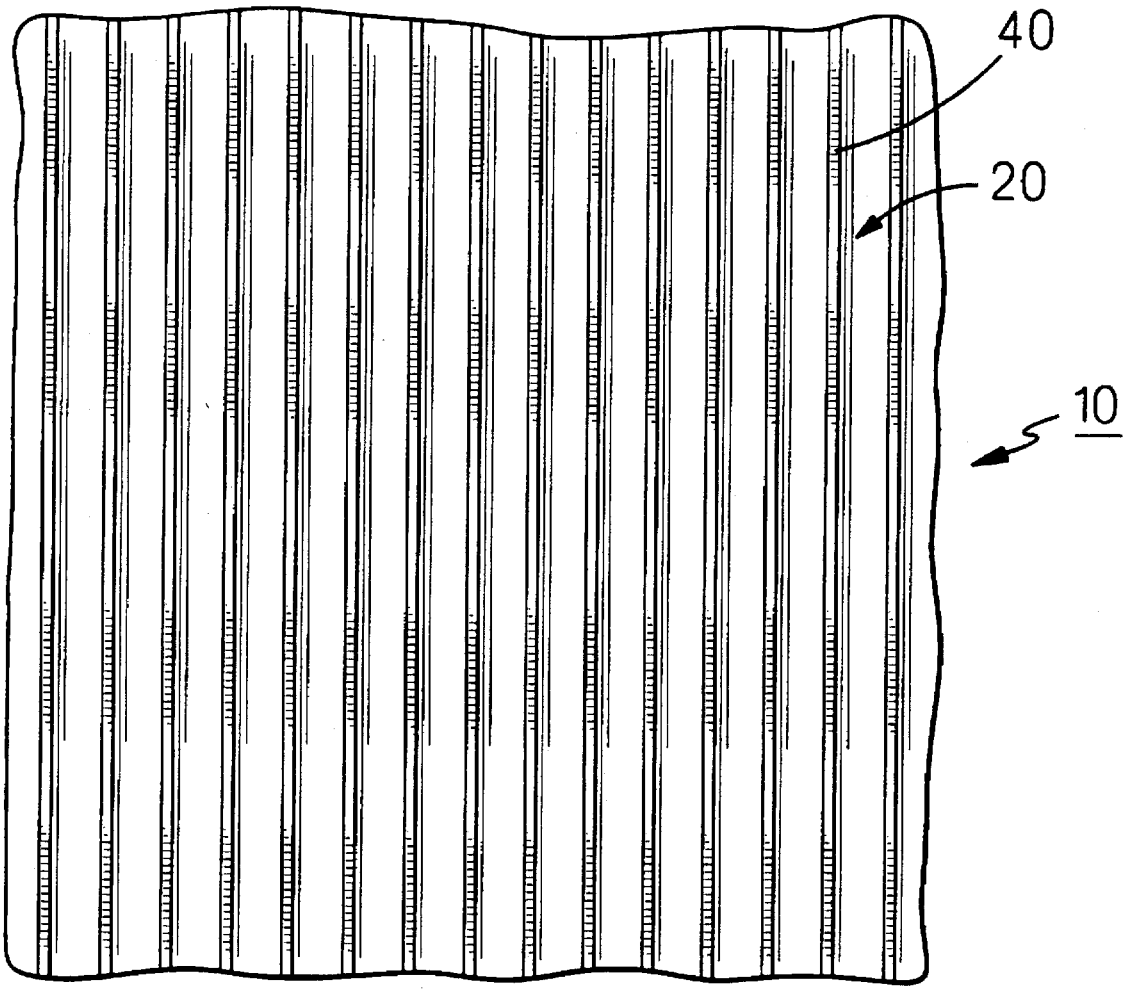
FIG. 2 is an enlarged, top plan view of the plate of FIG. 1.

FIGS. 1 and 2 illustrate a rear plate for a plasma display panel, generally indicated by the reference numeral 10. Plate 10 includes a substrate glass layer 12 on top of which is bonded thereto a barrier structure 14 of dielectric lead borosilicate glass. Barrier structure 14 includes a plurality of parallel troughs, as at 20, which may extend the full height of panel 10 without intermediate transverse barriers. Disposed at the base of each trough 20 is an electrode, as at 22 (FIG. 1), which is disposed between substrate glass 12 and dielectric structure 14, and which runs the full length of the trough. It will be understood that a conventional front plate having thereon electrode stripes orthogonal to electrodes 22 will be superposed over rear plate 10 when the plasma display of which rear plate 10 is a part is completed.

Linear stripes of conventional red, green, and blue phosphor materials 30, 32, 34, respectively, (FIG. 1) are disposed on the curved sidewalls of troughs 20, extending the length of the troughs parallel to electrodes 22. This arrangement provides a large surface area of phosphor in proximity to the plasma discharge, better utilizing ultraviolet energy generated in the discharge and increasing luminous efficiency.

Since only one color phosphor 30, 32, or 34 is placed in a trough 20, cross-talk in the lengthwise direction of a trough is not objectionable.

Troughs 20 are formed with conventional etching techniques at relatively low cost. Electrodes 22 perform the masking function during exposing photoresist on the top of the dielectric glass. After the photoresist is exposed through the backside of plate 10, the photoresist is developed and then the top surface of the glass is etched, creating troughs 20 with lands, as at 40, therebetween. Lands 40 are preferably quite narrow and are on the order of one to two thousandths of an inch wide. The linear glass barriers thus formed and linear phosphor stripes are compatible with self-registering photolithographic techniques which raises substrate mechanical tolerances for misalignment.

While the use of red, green, and blue phosphors is described as a means of attaining full color display, this invention also contemplates the use of single (same) color phosphor at locations 30, 32, and 34 to attain monochrome displays of any single desired color.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. A rear plate for a plasma display panel, comprising:

(a) a substrate including a dielectric glass layer thereon, said dielectric glass layer having an upper surface;

(b) a plurality of parallel, longitudinal, straight troughs defined in said upper surface, between walls of dielectric glass material defined in said upper surface, such that said dielectric glass layer and said walls comprise a monolithic structure;

(c) each trough having an electrode extending lengthwise along said trough in a base portion of said each trough, said electrode being disposed between said dielectric glass layer and said substrate;

(d) a linear stripe of phosphor material disposed lengthwise on sides of said walls along said each said trough, said phosphor material having a tear drop shape, with a lower portion of said phosphor material being substantially thicker, in cross-section, than an upper portion of said phosphor material.

2. A rear plate for a plasma display, as defined in claim 1, wherein: sides of each said wall of dielectric glass material are curved, such that bases of said walls of dielectric glass material are substantially thicker, in cross-section, than tops of said walls.

3. A rear plate for a plasma display, as defined in claim 1, wherein: said linear stripe of phosphor material emits red, green, or blue light, with no said linear stripes of phosphor in adjacent said troughs emitting light of the same color.

* * * * *